US006683775B2

(12) United States Patent
Rossi et al.

(10) Patent No.: US 6,683,775 B2
(45) Date of Patent: Jan. 27, 2004

(54) CONTROL METHOD FOR AN ELECTROMAGNETIC ACTUATOR FOR THE CONTROL OF AN ENGINE VALVE

(75) Inventors: Carlo Rossi, Bolonga (IT); Gianni Padroni, Portoferraio (IT); Riccardo Nanni, Bolonga (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 66 days.

(21) Appl. No.: 09/988,980

(22) Filed: Nov. 19, 2001

(65) Prior Publication Data

US 2002/0100439 A1 Aug. 1, 2002

(30) Foreign Application Priority Data

Nov. 21, 2000 (IT) ..... BO2000A0678

(51) Int. Cl.[7] ..... H01H 47/00
(52) U.S. Cl. ..... 361/143; 361/143
(58) Field of Search ..... 361/143, 152, 361/154, 160, 146, 147

(56) References Cited

U.S. PATENT DOCUMENTS 6,044,814 A 4/2000 Fuwa
6,227,650 B1 * 5/2001 Matsuda ..... 347/47
6,249,418 B1 * 6/2001 Bergstrom ..... 361/152
6,397,798 B1 6/2002 Fiaccabrino
6,450,478 B2 * 9/2002 Parsons et al. ..... 251/129.04
6,453,855 B1 * 9/2002 Di Lieto et al. ..... 123/90.11
6,481,396 B2 * 11/2002 Stolk et al. ..... 123/90.11

FOREIGN PATENT DOCUMENTS

| | | |
|---|---|---|
| DE | 19544207 | 6/1997 |
| EP | 0 959 479 A2 | 11/1999 |
| EP | 1 049 114 A2 | 11/2000 |
| JP | 10122059 | 5/1998 |

* cited by examiner

*Primary Examiner*—Gregory J. Toatley, Jr.
*Assistant Examiner*—Danny Nguyen
(74) *Attorney, Agent, or Firm*—Carter J. White; Howrey Simon Arnold & White LLP

(57) ABSTRACT

A control method for an electromagnetic actuator for the control of an engine valve in which at least one electromagnet displaces an actuator body under the action of the force of magnetic attraction generated by the electromagnet, the electrical supply of the electromagnet being controlled as a function of an objective value of the magnetic flux circulating in the magnetic circuit formed by the electromagnet and the actuator body.

17 Claims, 3 Drawing Sheets

CONTROL METHOD FOR AN ELECTROMAGNETIC ACTUATOR FOR THE CONTROL OF AN ENGINE VALVE

This application claims priority under 35 USC §119 of application number BO 2000A 000678, filed on Nov. 21, 2000 in Italy.

The present invention relates to a control method for an electromagnetic actuator for the control of an engine valve.

BACKGROUND OF THE INVENTION

As is known, internal combustion engines of the type disclosed in Italian Patent Application B099A000443 filed on Aug. 4, 1999 are currently being tested, in which the movement of the intake and exhaust valves is performed by electromagnetic actuators. These electromagnetic actuators have undoubted advantages since they make it possible to control each valve according to a law optimised with respect to any operating condition of the engine, whereas conventional mechanical actuators (typically camshafts) make it necessary to define a lift profile of the valves which is an acceptable compromise for all the possible operating conditions of the engine.

An electromagnetic actuator for a valve of an internal combustion engine of the type described above normally comprises at least one electromagnet adapted to displace an actuator body of ferromagnetic material mechanically connected to the stem of the respective valve. In order to apply a particular law of motion to the valve, a control unit drives the electromagnet with a current that varies over time in order appropriately to displace the actuator body.

Known control units in particular control the voltage applied to the coil of the electromagnet in order to cause a current intensity determined as a function of the desired position of the actuator to circulate in this coil. It has been observed from experimental tests, however, that known control units of the type described above are not able to guarantee a sufficiently precise control of the law of motion of the actuator body.

SUMMARY OF THE INVENTION

The object of the present invention is to provide a control method for an electromagnetic actuator for the control of an engine valve that is free from the drawbacks described above and that is in particular simple and economic to embody.

The present invention therefore relates to a control method for an electromagnetic actuator for the control of an engine valve as claimed in claim 1.

BRIEF DESCRIPTION OF THE DRAWINGS

The present invention will be described below with reference to the accompanying drawings, which show a non-limiting embodiment thereof, in which.

DETAILED DESCRIPTION OF THE INVENTION

Figure 1:
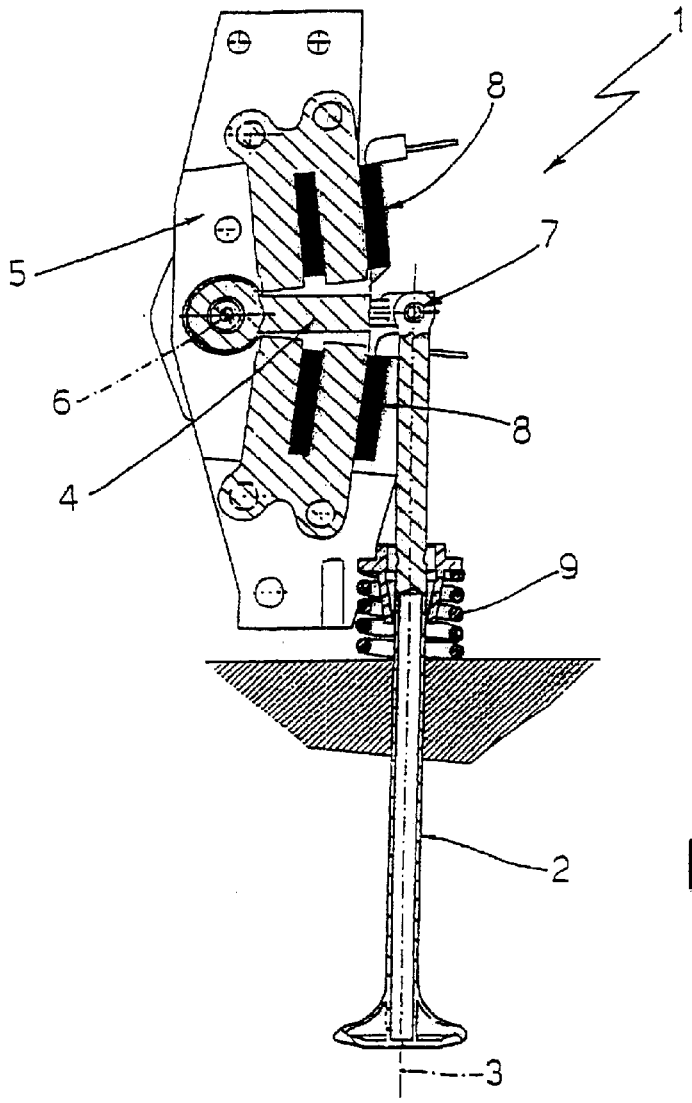
FIG. 1 is a diagrammatic view, in lateral elevation and partly in section, of an engine valve and of a relative electromagnetic actuator operating in accordance with the method of the present invention.

In FIG. 1, an electromagnetic actuator (of the type disclosed in Italian Patent Application B099A000443 filed on Aug. 4, 1999) is shown overall by 1 and is coupled to an intake or exhaust valve 2 of an internal combustion engine of known type in order to displace this valve 2 along a longitudinal axis 3 of the valve between a closed position (not shown) and a position of maximum opening (not shown).

The electromagnetic actuator 1 comprises an oscillating arm 4 at least partly of ferromagnetic material which has a first end hinged on a support 5 so that it can oscillate about an axis 6 of rotation perpendicular to the longitudinal axis 3 of the valve 2, and a second end connected by means of a hinge 7 to an upper end of the valve 2. The electromagnetic actuator 1 further comprises two electromagnets 8 borne in a fixed position by the support 5 so that they are disposed on opposite sides of the oscillating arm 4, and a spring 9 coupled to the valve 2 and adapted to maintain the oscillating arm 4 in an intermediate position (shown in FIG. 1) in which the oscillating arm 4 is equidistant from the polar expansions 10 of the two electromagnets 8.

In operation, the electromagnets 8 are controlled by a control unit 11 (shown in FIG. 2) so as alternatively or simultaneously to exert a force of attraction of magnetic origin on the oscillating arm 4 in order to cause it to rotate about the axis 6 of rotation, thereby displacing the valve 2 along the respective longitudinal axis 3 and between the above-mentioned closed and maximum open positions (not shown). The valve 2 is in particular in the above-mentioned closed position (not shown) when the oscillating arm 4 is in abutment on the lower electromagnet 8 and is in the above-mentioned position of maximum opening when the oscillating arm 4 is in abutment on the upper electromagnet 8, and is in a partially open position when neither of the electromagnets 8 are being supplied and the oscillating arm 4 is in the above-mentioned intermediate position (shown in FIG. 1) as a result of the force exerted by the spring 9.

Figure 2:
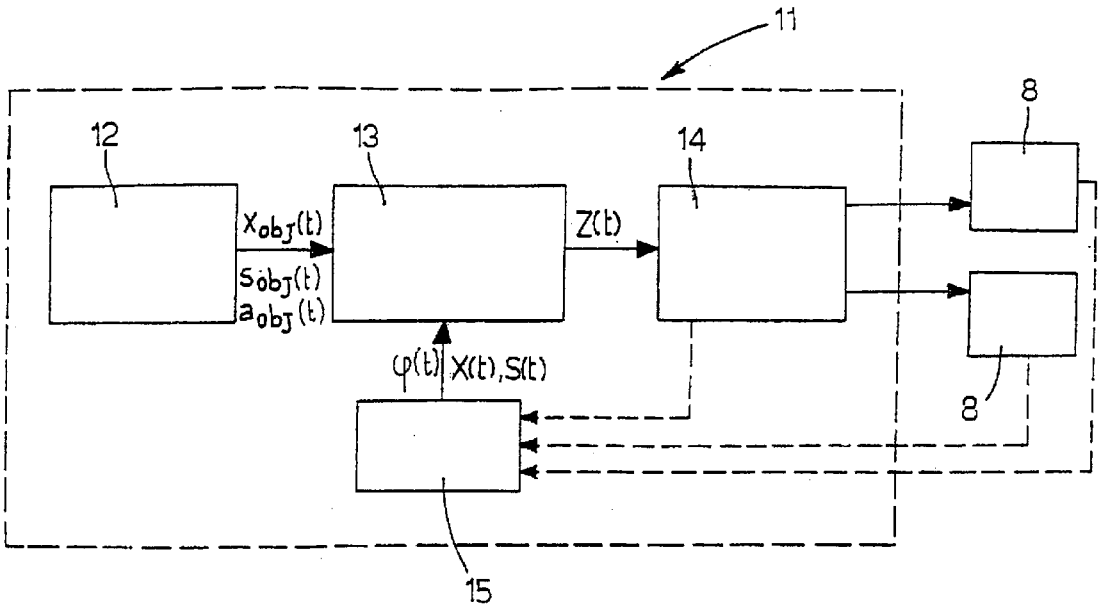
FIG. 2 is a diagrammatic view of a control unit of the actuator of FIG. 1.
Figure 3:
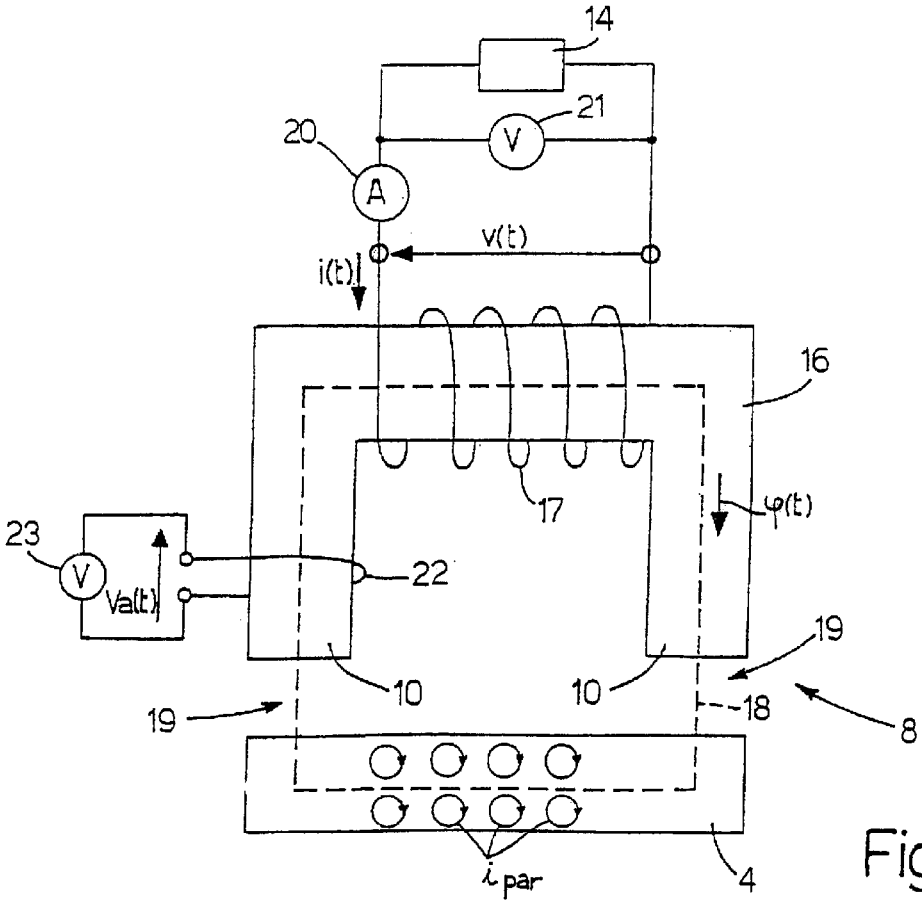
FIG. 3 is a diagrammatic view of an electromagnetic circuit of the control unit of FIG. 2.

As shown in FIG. 2, the control unit 11 comprises a reference generation block 12, a control block 13, a drive block 14 adapted to supply the electromagnets 8 with a voltage v(t) variable over time and an estimation block 15 which is adapted to estimate, substantially in real time, the position x(t) of the oscillating arm 4, the speed s(t) of the oscillating arm and the flux Φ(t) circulating through the oscillating arm 4 by means of measurements of electrical magnitudes of the drive block 14 and/or of the two electromagnets 8. As shown in FIG. 3, each electromagnet 8 comprises a respective magnetic core 16 coupled to a corresponding coil 17 which is supplied by the drive block 14 as a function of commands received from the control block 13.

In operation, the reference generation block 12 receives as input a plurality of parameters indicating the operating conditions of the engine (for instance the load, the number of revolutions, the position of the butterfly body, the angular position of the drive shaft, the temperature of the cooling fluid) and supplies the control block 13 with an objective law of motion of the oscillating arm 4 (and therefore of the valve 2). This objective law of motion of the oscillating arm 4 is described by the combination of the objective value $x_{obj}(t)$ of the position of the oscillating arm 4, the objective value $s_{obj}(t)$ of the speed of the oscillating arm 4 and the objective value $a_{obj}(t)$ of the acceleration of the oscillating arm 4.

The control block 13, on the basis of the objective law of motion of the oscillating arm 4 and on the basis of the estimated values x(t), s(t) and Φ(t) received from the estimation block 15, processes and supplies a control signal z(t) for driving the electromagnets 8 to the drive block 14.

The control methods for the electromagnets 8 used by the control unit 11 are described below with particular reference to FIG. 3, in which a single electromagnet 8 is shown for simplicity, and with particular reference to FIG. 5, in which the control unit 11 is shown in further detail.

In operation, when the drive block 14 applies a voltage v(t) variable over time to the terminals of the coil 17 of the electromagnet 8, the coil 17 is traversed by a current i(t) thereby generating the flux Φ(t) via a magnetic circuit 18 coupled to the coil 17. The magnetic circuit 18 coupled to the coil 17 is in particular composed of the core 16 of ferromagnetic material of the electromagnet 8, the oscillating arm 4 of ferromagnetic material and an air gap 19 existing between the core 16 and the oscillating arm 4.

Applying the generalised Ohm's law to the electrical circuit formed by the coil 17 provides differential equation [1] (in which N is the number of turns of the coil 17):

$$v(t)=N*d\Phi(t)/dt+RES*i(t) \quad [1]$$

The magnetic circuit 18 has an overall reluctance R defined by the sum of the reluctance $R_{fe}$ of iron and the reluctance $R_0$ of the air gap 19; the value of the flux Φ(t) circulating in the magnetic circuit 18 is linked to the value of the current i(t) circulating in the coil 17 by equation [2]:

$$N*i(t)=R*\Phi(t)=(R_{fe}+R_0)*\Phi(t) \quad [2]$$

In general, the value of the overall reluctance R depends both on the position x(t) of the oscillating arm 4 (i.e. on the amplitude of the air gap 19, which is equal, less a constant, to the position x(t) of the oscillating arm 4) and on the value assumed by the flux Φ(t). Less negligible errors (i.e. as a first approximation), it can be assumed that the reluctance value of iron $R_{fe}$ depends solely on the value assumed by the flux Φ(t), while the reluctance value of the air gap $R_0$ depends solely on the position x(t), i.e.:

$$R(x(t),\ \Phi(t))=R_{fe}(\Phi(t))+R_0(x(t)) \quad [3]$$

$$N*i(t)=R(x(t),\ \Phi(t))*\Phi(t) \quad [4]$$

$$N*i(t)=R_{fe}((\Phi(t))*\Phi(t)+R_0(x(t))*\Phi(t) \quad [5]$$

$$N*i(t)=H_{fe}(\Phi(t))+R_0(x(t))*\Phi(t) \quad [6]$$

The relationship between the air gap reluctance $R_0$ and the position x(t) can be obtained in a relatively simple manner by analysing the characteristics of the magnetic circuit 18; an example of a model of the behaviour of the air gap 19 is shown by equation [7]:

$$R_o(x(t))=K_1[1-e^{-k_2\cdot x(t)}+k_3\cdot x(t)]+K_0 \quad [7]$$

in which $K_0$, $K_1$, $K_2$, $K_3$ are constants that can be obtained experimentally by a series of measurements of the magnetic circuit 18.

Applying the laws of electromagnetism to the magnetic circuit 18 provides equation [8] which makes it possible to calculate the value of the force f(t) of attraction exerted by the electromagnet 8 on the oscillating arm 4 (equation [9] is obtained simply from equation [8]):

$$f(t)=-\frac{1}{2}\cdot\frac{\partial R(x(t),\ \varphi(t))}{\partial x}.\varphi^2(t)=-\frac{1}{2}\cdot\left(\frac{\partial R_0(x(t))}{\partial x}\right)_\varphi\cdot\varphi^2(t) \quad [8]$$

$$\varphi(t)=\sqrt{\frac{-2\cdot f(t)}{\left(\frac{\partial R_0(x(t))}{\partial x}\right)_\varphi}} \quad [9]$$

Lastly the mechanical model of the oscillating arm 4 is provided by equation [10]:

$$M*a(t)-B*s(t)-K_e*(x(t)-X_e)-P_e=f(t) \quad [10]$$

in which:

M is the mass of the oscillating arm 4;

B is the coefficient of hydraulic friction to which the oscillating arm 4 is subject;

$K_e$ is the elastic constant of the spring 9;

$X_e$ is the position of the oscillating arm 4 corresponding to the rest position of the spring 9;

$P_e$ is the preloading force of the spring 9;

f(t) is the force of attraction exerted by the electromagnet 8 on the oscillating arm 4.

Figure 5:
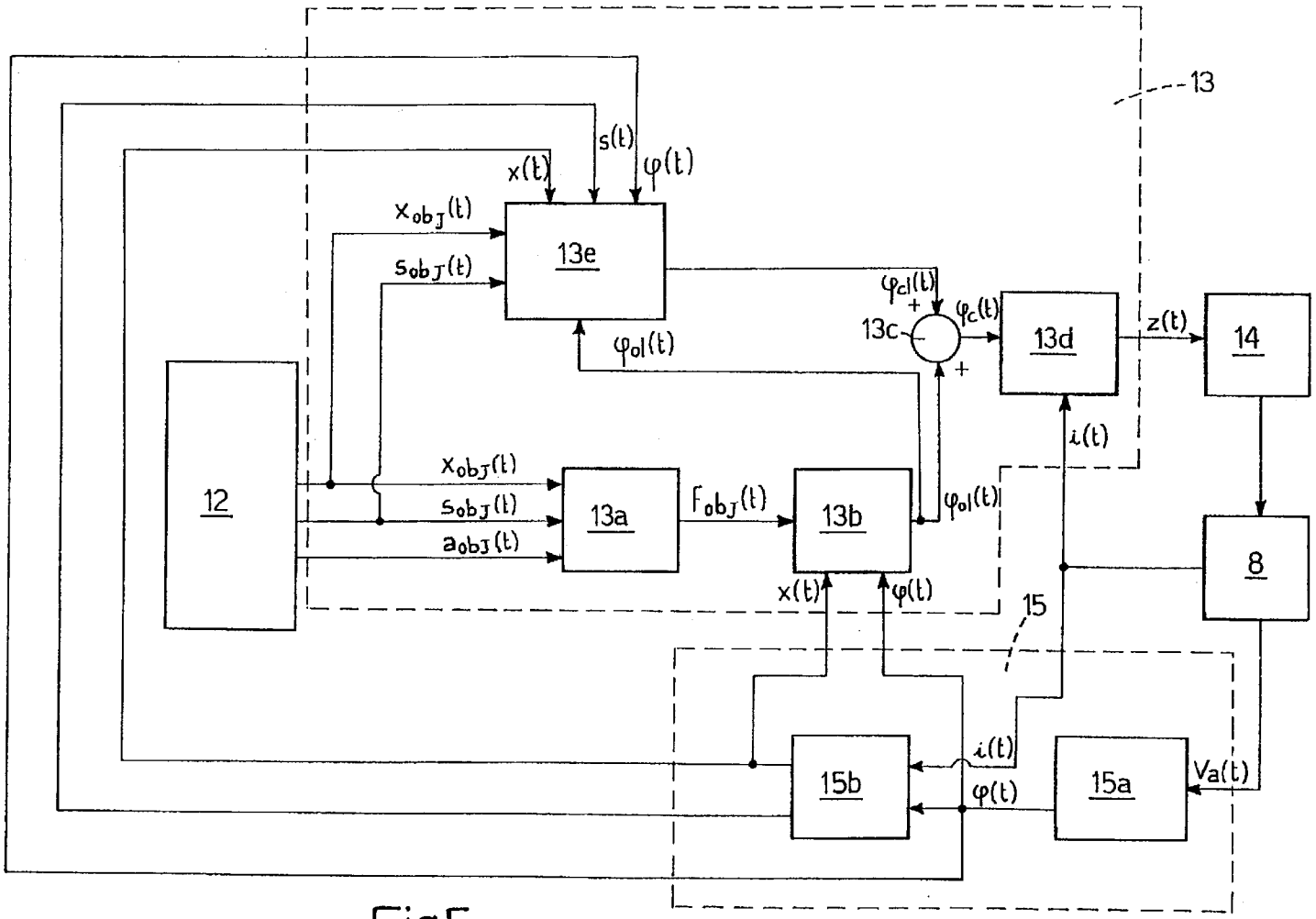
FIG. 5 is a diagrammatic view in further detail of the control unit of FIG. 3.

As shown in FIG. 5, the reference generation block 12 supplies the objective law of motion of the oscillating arm 4 to a calculation member 13*a* of the block 13, which objective law of motion is defined by the objective value $x_{obj}(t)$ of the position of the oscillating arm 4, the objective value $s_{obj}(t)$ of the speed of the oscillating arm 4 and the objective value $a_{obj}(t)$ of the acceleration of the oscillating arm 4. On the basis of the values $x_{obj}(t)$, $s_{obj}(t)$ and $a_{obj}(t)$ received from the generation block 12 and applying equation [10], the calculation member 13*a* calculates an objective value $f_{obj}(t)$ of the force that the electromagnet 8 has to exert on the oscillating arm 4 in order to cause it to perform the objective law of motion established by the reference generation block 12.

A calculation member 13*b* of the control member 13 receives as input the objective force value $f_{obj}(t)$ from the calculation member 13*a*, and the values of the position x(t) of the oscillating arm 4 and the flux Φ(t) circulating through the magnetic circuit 18 from the estimation block 15; as a function of the values $f_{obj}(t)$, x(t), and Φ(t) and applying equation [9], the calculation member 13*b* calculates an objective value $\Phi_{ol}(t)$ of the magnetic flux that has to circulate through the magnetic circuit 18 to generate the objective value $f_{obj}(t)$ of the force that the electromagnet 8 has to exert on the oscillating arm 4.

The objective value $\Phi_{ol}(t)$ of the magnetic flux is a value calculated according to an open loop control logic, since account is not taken of any interference to which the electromagnet 8 may be subject in the calculation of this objective value $\Phi_{ol}(t)$; for this reason, a summing member 13*c* adds a further objective value $\Phi_{cl}(t)$ of the magnetic flux to the objective value $\Phi_{ol}(t)$ of the magnetic flux to obtain an overall objective value $\Phi_c(t)$ of the magnetic flux. The overall objective value $\Phi_{ol}(t)$ of the magnetic flux is supplied by the summing member 13*c* to a calculation member 13*d* which, as a function of the overall objective value $\Phi_c(t)$, generates the control signal z(t) for driving the electromagnet 8.

The further objective value $\Phi_{ol}(t)$ is generated by a calculation member 13*e* of the control block by means of known feedback control techniques in order to take account of any interference to which the electromagnet 8 may be subject. In particular, the further objective value $\Phi_{ol}(t)$ is generated by means of feedback of the estimated real state of the oscillating arm 4 with respect to the objective state of the oscillating arm 4; the estimated real state of the oscillating arm 4 is defined by the values estimated by the estimation block 15 of the position x(t) of the oscillating arm 4, of the speed s(t) of the oscillating arm 4 and of the magnetic flux Φ(t), while the objective state of the oscillating arm 4 is defined by the objective value $x_{obj}(t)$ of the position of the oscillating arm 4, by the objective value $s_{obj}(t)$ of the speed of the oscillating arm 4 and by the objective value $\Phi_{ol}(t)$ of the magnetic flux.

According to a preferred embodiment, the electromagnet 8 is driven in voltage and the control signal z(t) generated by the calculation member 13*d* substantially indicates the value of the voltage v(t) to be applied to the coil 17 of the electromagnet 8; the calculation member 13*d* receives as input the overall objective value $\Phi_c(t)$ of the magnetic flux and the measured value i(t) (measured by an ammeter 20) of the current circulating through the coil 17 and by applying equation [1] calculates the value of the voltage v(t) to be applied to the coil 17 to obtain the generation of the overall objective value $\Phi_c(t)$ of the magnetic flux.

According to a preferred embodiment, the electromagnet 8 is driven in voltage by means of a switching amplifier integrated in the drive block 14; the voltage v(t) applied to the coil 17 of the electromagnet 8 therefore varies continuously between three values ($+V_{supply}$, 0, $-V_{supply}$) and the control signal z(t) indicates the PWM, i.e. the time sequence of alternation of the three voltage values to be applied to the coil 17.

According to a different embodiment (not shown), the control block 13 does not comprise the calculation member 13*e* and the control of the magnetic flux Φ(t) is carried out exclusively according to an open loop control logic, i.e. using only the objective value $\Phi_{ol}(t)$ of the magnetic flux.

It will be appreciated from the above that the electrical supply of the electromagnet 8 is controlled as a function of an overall objective value $\Phi_c(t)$ of the magnetic flux Φ(t) circulating in the magnetic circuit 18; controlling the electromagnets 8 as a function of the magnetic flux Φ(t) makes it possible for the oscillating arm 4 and therefore the valve 2 very precisely to respect the objective law of motion.

The methods used by the estimation block 15 to calculate the value of the flux Φ(t), the value of the position x(t) of the oscillating arm 4 and the value of the speed s(t) of the oscillating arm 4 are described below with particular reference to FIG. 3.

By resolving the above-mentioned equation [6] with respect to $R_0(x(t))$, it is possible to obtain the air gap reluctance value $R_0$ when the value of the current i(t) (which value can be readily measured by an ammeter 20) is known, when the value of N (fixed and dependent on the constructional characteristics of the coil 17) is known, when the value of the flux Φ(t) is known and when the relationship existing between the reluctance of iron $R_{fe}$ and the flux Φ (known from the constructional characteristics of the magnetic circuit 18 and the magnetic properties of the material used, i.e. readily obtainable from experimental tests) is known.

Once the relationship between the air gap reluctance $R_0$ and the position x is known (for instance of the type provided by equation [7] above), the position x can be obtained from the air gap reluctance $R_0$ by applying the inverse relationship (that can be applied either by using the exact equation, or by a applying an approximated digital calculation method) The above can be summarised in equations (11] and [12]:

$$R_0(x(t)) = \frac{N \cdot i(t) - H_{fe}(\varphi(t))}{\varphi(t)} \quad [11]$$

$$R_o(x(t)) = K_1[1 - e^{-k_2 \cdot x(t)} + K_3 \cdot x(t)] + K_0 \quad [7]$$

$$x(t) = R_0^{-1}(R_o(x(t))) = R_0^{-1}\left(\frac{N \cdot i(t) - H_{fe}(\varphi(t))}{\varphi(t)}\right) \quad [12]$$

It will be appreciated that if it is possible to measure the flux Φ(t) it is possible to calculate the position x(t) of the oscillating arm 4 in a relatively simple manner. Moreover, starting from the value of the position x(t) of the oscillating arm 4 it is possible to calculate the value of the speed s(t) of this oscillating arm 4 by a simple operation of derivation over time of the position x(t).

According to a first embodiment, the flux Φ(t) can be calculated by measuring the current i(t) circulating through the coil 17 by means of the ammeter 20, by measuring the voltage v(t) applied to the terminals of the coil 17 by means of a voltmeter and by knowing the value of the resistance RES of the coil 17 (which value can be readily measured). This method of measurement of the flux Φ(t) is based on equations [13] and [14]:

$$\frac{d\varphi(t)}{dt} - \frac{1}{N} \cdot (v(t) - RES \cdot i(t)) \quad [13]$$

$$\varphi(T) = \frac{1}{N} \cdot \int_0^T (v(t) - RES \cdot i(t))\,dt + \varphi(0) \quad [14]$$

The conventional instant 0 is selected such that the value of the flux Φ(0) at this instant 0 is precisely known; in particular, the instant 0 is normally selected within a time interval during which current does not pass through the coil 17 and, therefore, the flux Φ is substantially zero (the effect of any residual magnetisation is negligible), or the instant 0 is chosen at a predetermined position of the oscillating arm 4 (typically when the oscillating arm 4 is in abutment on the polar expansions 10 of the electromagnet 8), at which the value of the position x, and therefore the value of the flux Φ, is known.

The method described above for the calculation of the flux Φ(t) is fairly precise and rapid (i.e. free from delays); however, this method raises some problems due to the fact that the voltage v(t) applied to the terminals of the coil 17 is normally generated by a switching amplifier integrated in the drive block 14 and therefore varies continuously between three values ($+V_{supply}$, 0, $-V_{supply}$), two of which ($+V_{supply}$, e$-V_{supply}$) have a relatively high value and are therefore difficult to measure precisely without the assistance of relatively complex and costly measurement circuits. Moreover, the method described above for the calculation of the flux Φ(t) requires continuous reading of the current i(t) circulating through the coil 17 and a continuous knowledge of the value of the resistance RES of the coil 17 which resistance value, as is known, varies with variations in the temperature of the coil 17.

According to a preferred embodiment, the magnetic core 16 is coupled to an auxiliary coil 22 (composed of at least one turn and generally provided with a number $N_a$ of turns) to whose terminals a further voltmeter 23 is connected; as the terminals of the coil 22 are substantially open (the internal resistance of the voltmeter 23 is so high that it can be considered infinite without thereby introducing appreciable errors), no current passes through the coil 22 and the voltage $v_a(t)$ at its terminals depends solely on the derivative of the flux $\Phi(t)$ over time, from which it is possible to obtain the flux by means of an integration operation (reference should be made to the considerations discussed above as regards the value $\Phi(0)$):

$$\frac{d\varphi(t)}{dt} - \frac{1}{N_a} \cdot v_a(t) \quad [15]$$

$$\varphi(T) = \frac{1}{N_a} \cdot \int_0^T v_a(t)dt + \varphi(0) \quad [16]$$

The use of the reading of the voltage $v_a(t)$ of the auxiliary coil 22 makes it possible to avoid any kind of measurements and/or estimations of electrical current and electrical resistance in order to calculate the flux $\Phi(t)$; moreover, the value of the voltage $v_a(t)$ is linked to the value of the voltage v(t) (less dispersions) by equation [17]:

$$v_a(t) = \frac{N_a}{N} \cdot (v(t) - RES \cdot i(t)) \quad [17]$$

as a result of which, by appropriately dimensioning the number of turns $N_a$ of the auxiliary coil 22, it is possible relatively simply to keep the value of the voltage $v_a(t)$ within a measurable interval in a precise manner.

It will be appreciated from the above that, by using the reading of the voltage $v_a(t)$ of the auxiliary coil 22, the calculation of the value of the flux $\Phi(t)$ is more precise, more rapid and simpler with respect to the use of the reading of the voltage v(t) at the terminals of the coil 17.

In the above description, two methods of estimating the derivative of the flux $\Phi(t)$ over time have been given. According to an embodiment, it is chosen to use only one method for the calculation of the derivative of the flux $\Phi(t)$. According to a further embodiment, it is chosen to use both methods for the calculation of the derivative of the flux $\Phi(t)$ over time and to use a mean (possibly weighted with respect to the estimated precision) of the results of the two methods applied or to use one result to verify the other (if there is a substantial discrepancy between the two results, it is probable that an error has occurred in the estimates).

It will lastly be appreciated that the above-described methods for the estimation of the position x(t) can be used only when current is passing through the coil 17 of an electromagnet 8. For this reason, the estimation block 15 works with both the electromagnets 8 in order to use the estimate performed with one electromagnet 8 when the other is de-activated. When both the electromagnets 8 are active, the estimation block 15 calculates a mean of the two values x(t) calculated with the two electromagnets 8, possibly weighted as a function of the precision attributed to each value x(t) (generally the estimation of the position x carried out with respect to an electromagnet 8 is more precise when the oscillating arm 4 is relatively close to the polar expansions 10 of this electromagnet 8).

It has been observed that as a result of the rapid displacements of the oscillating arm 4 affected by the magnetic field generated by an electromagnet 8, parasitic currents $i_{par}$ which are substantially of pulse type and are relatively high are induced in this oscillating arm 4. In particular, these parasitic currents $i_{par}$ are responsible, together with the current i(t) circulating in the coil 17, for the generation of the flux $\Phi(t)$ passing through the magnetic circuit 18 by supplying a contribution $h_p(t)$ of ampere-turns to the generation of this flux $\Phi(t)$; consequently, equation [6] is modified according to relationship [6']:

$$N^*i(t)+h_p(t)=H_{fe}(\Phi(t))+R_0(x(t))^* \Phi(t) \quad [6']$$

and equations [11] and [12 ] are modified according to relationships [11'] and [12']:

$$R_0(x(t)) = \frac{N \cdot i(t) + h_p(t) - H_{fe}(\varphi(t))}{\varphi(t)} \quad [11']$$

$$x(t) = R_0^{-1}(R_0(x(t))) = R_0^{-1}\left(\frac{N \cdot i(t) + h_p(t) - H_{fe}(\varphi(t))}{\varphi(t)}\right) \quad [12']$$

It will be appreciated that if, in the estimation of the position x(t) of the oscillating arm 4, no account is taken of the effect of the parasitic currents $i_{par}$, the estimation of the position x(t) will be incorrect by a value that is the higher the more intense the parasitic currents $i_{par}$.

Figure 4:
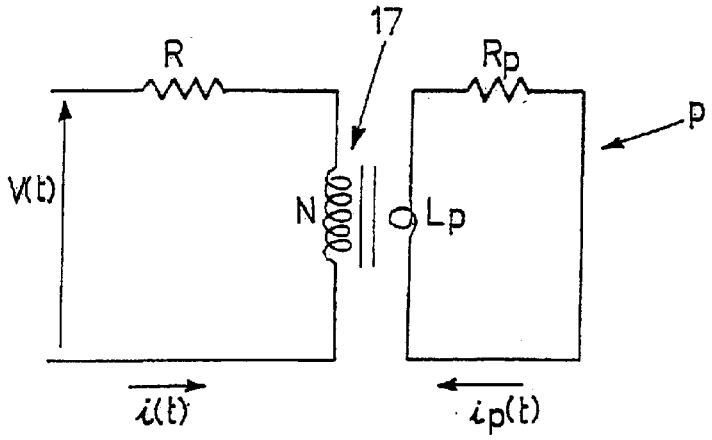
FIG. 4 is a diagrammatic view of an electrical circuit modelling the behaviour of parasitic currents induced in the electromagnetic actuator of FIG. 1.

In order to try to estimate the contributions $h_p(t)$ of ampere-turns of the parasitic currents $i_{par}$, it is possible to model these parasitic currents $i_{par}$ with a single equivalent parasitic current $i_p(t)$, which circulates in a single equivalent turn p (shown in FIG. 4) magnetically coupled to the magnetic circuit 18 in which the magnetic flux $\Phi(t)$ is circulating; the turn p has its own resistance $R_p$, its own inductance $L_p$ and is closed in short-circuit. The values of the resistance $R_p$ and the inductance $L_p$ of the turn p may be obtained in a relatively simple manner by a set of experimental measurements of the electromagnet 8. The electrical circuit of the turn p is described by the differential equation [19] obtained from the application of the generalised Ohm's law:

$$-R_p \cdot i_p(t) = \frac{d\varphi(t)}{dt} + L_p \cdot \frac{di_p(t)}{dt} \quad [18]$$

Moving onto the L-transforms (Laplace transforms) and obtaining the transfer function of the current $i_p$ in the plane of the Laplace transforms provides equations [19] and [20]:

$$-R_p \cdot I_p = s \cdot \Phi + L_p s \cdot \Phi \quad [19]$$

$$I_p = -\frac{s}{L_p \cdot s + R_p} \cdot \Phi \quad [20]$$

Once the values of the resistance $R_p$ and the inductance $L_p$ of the turn p are known and once the value of the magnetic flux $\Phi(t)$ has been estimated by one of the two methods described above, the value of the equivalent parasitic current $i_p(t)$ can be obtained by applying a known method of L-antitransformation to equation [20]; preferably, the value of the equivalent parasitic current $i_p(t)$ is obtained by making equation [20] discrete and applying a digital method (that can be readily implemented via software).

It will be appreciated that the equivalent parasitic current $i_p(t)$ is applied to the magnetic circuit 18 by circulating in a single equivalent turn p, and therefore the equivalent parasitic current $i_p(t)$ produces a contribution $h_p(t)$ of ampere-turns equal to its intensity, i.e.:

$$h_p(t)=i_p(t) \cdot 1 \quad [21]$$

$$R_0(x(t)) = \frac{N \cdot i(t) + i_p(t) - H_{fe}(\varphi(t))}{\varphi(t)} \quad [11']$$

-continued $$x(t) = R_0^{-1}(R_0(x(t))) = R_0^{-1}\left(\frac{N \cdot i(t) + i_p(t) - H_{fe}(\varphi(t))}{\varphi(t)}\right) \quad [12']$$

What is claimed is:

1. A control method for an electromagnetic actuator (1) for the control of an engine valve (2), the method comprising the electrical supply of at least one electromagnet (8) for generating a force (f) of magnetic attraction acting on an actuator body (4), and being characterised in that an objective value ($\Phi_c$) of the magnetic flux ($\Phi$) circulatng in the magnetic circuit (18) formed by the electromagnet (8) and the actuator body (4) is determined and in that the electrical supply (i, v) of the electromagnet (8) is controlled as a function of the objective value ($\Phi_c$) of the magnetic flux ($\Phi$), and wherein the objective value ($\Phi_c$) of the magnetic flux ($\Phi$) is calculated as a function of an objective value ($f_{obj}$) of the force (f) of magnetic attraction acting on the actuator body (4) and generated by the electromagnet (8), and wherein the objective value ($\Phi_c$) of the magnetic flux ($\Phi$) is calculated by applying the following equation:

$$\varphi_c(t) = \sqrt{\frac{-2 \cdot f_{obj}(t)}{\left(\frac{\partial R(x(t))}{\partial x}\right)_\varphi}}$$

in which:

$\Phi_c(t)$ is the objective value of the magnetic flux ($\Phi$);

$f_{obj}(t)$ is the objective value of the force (f) of magnetic attraction;

x(t) is the position of the actuator body (4);

R(x, $\Phi$) is the reluctance of the magnetic circuit (18).

2. A method as claimed in claim 1, characterised in that the electromagnet (8) comprises a coil (17) which is supplied with a variable voltage (v) whose value is determined by applying the equation:

$$v(t)=N*dp(t)/dt+RES*i(t)$$

in which:

v(t) is the variable voltage applied to the terminals of the coil (17);

N is the number of turns of the coil (17);

$\Phi(t)$ is the magnetic flux ($\Phi$) circulating in the magnetic circuit (18);

RES is the resistance of the coil (17);

i(t) is the electrical current circulating through the coil (17).

3. A method as claimed in claim 1, characterised in that the objective value ($\Phi_c$) of the magnetic flux ($\Phi$) is calculated as the sum of a first contribution ($\Phi_{ol}$) calculated according to an open loop control logic and a second contribution ($\Phi_{cl}$) calculated a cording to a closed loop control logic.

4. A method as claimed in claim 3, characterised in that the first contribution ($\Phi_{ol}$) is calculated as a function of an objective value ($f_{obj}$) of the force (f) of magnetic attraction acting on the actuator body (4) and generated by the electromagnet.

5. A method as claimed in claim 4, characterised in that the objective value ($\Phi_c$) of the magnetic flux ($\Phi$) is calculated by applying the following equation:

$$\varphi_{ol}(t) = \sqrt{\frac{-2 \cdot f_{obj}(t)}{\left(\frac{\partial R(x(t))}{\partial x}\right)_\varphi}}$$

in which $\Phi_{ol}(t)$ is the first contribution of the objective value ($\Phi_c$) of the magnetic flux ($\Phi$);

$f_{obj}(t)$ is the objective value of the force (f) of magnetic attraction;

x(t) is the position of the actuator body (4);

R(x, $\Phi$) is the reluctance of the magnetic circuit (18).

6. A method as claimed in claim 1, characterised in that the objective value ($f_{obj}$) of the force (f) of magnetic attraction is calculated as a function of an objective law of motion of the actuator body (4).

7. A method as claimed in claim 6, characterised in that the objective value ($f_{obj}$) of the force (f) of magnetic attraction is calculated by applying the following equation:

$$f_{obj}(t)=M*a_{obj}(t)-B*S_{obj}(t)-K_e*(X_{obj}(t)-X_e)-P_e$$

in which:

$f_{obj}(t)$ is the objective value of the force (f) of magnetic attraction;

M is the mass of the actuator body (4);

B is the coefficient of hydraulic friction to which the actuator body (4) is subject;

$K_e$ is the elastic constant of a spring (9) acting on the actuator body (4);

$X_e$ is the position of the actuator body (4) corresponding to the rest position of the spring (9);

$P_e$ is the preloading force of the spring (9);

$x_{obj}(t)$ is the objective position of the actuator body (4);

$s_{obj}(t)$ is the objective speed of the actuator body (4);

$a_{obj}(t)$ is the objective acceleration of the actuator body (4).

8. A method as claimed in claim 3, characterised in that the second contribution ($\Phi_{cl}$) is calculated by feedback of an estimated real state of the actuator body (4) with respect to an objective state of the actuator body (4).

9. A method as claimed in claim 5, characterised in that the estimated real state of the actuator body (4) is defined from the estimated values of the position (x) of the actuator body (4), the speed (s) of the actuator body (4), and the magnetic flux ($\Phi$), the objective state of the actuator body (4) being d fined from the objective value ($x_{obj}$) of the position of the actuator body (4), the objective value ($s_{obj}$) of the speed of the actuator body (4) and the first contribution ($\Phi_{ol}$) of the objective value ($\Phi_c$) of the magnetic flux ($\Phi$).

10. A method as claimed in claim 1, in which the value of the magnetic flux ($\Phi$) is estimated by measuring the value assumed by some electrical magnitudes (i, v; $v_a$) of an electrical circuit (17; 22) coupled to the magnetic circuit (18), calculating the derivative over time of the magnetic flux ($\Phi$) as a linear combination of the values of the electrical magnitudes (i, v; $v_a$) and integrating the derivative of the magnetic flux ($\Phi$) over time.

11. A method as claimed in claim 10, characterised in that the current (i) circulating through a coil (17) of the electromagnet (8) and the voltage (v) applied to the terminals of this coil (17) are measured, the derivative over time of the magnetic flux (Φ) and the magnetic flux itself (Φ) being calculated by applying the following formulae:

$$\frac{d\varphi(t)}{dt} = \frac{1}{N} \cdot (v(t) - RES \cdot i(t))$$

$$\varphi(T) = \frac{1}{N} \cdot \int_0^T (v(t) - RES \cdot i(t))\,dt + \varphi(0)$$

in which:

Φ is the magnetic flux (Φ);

N is the number of turns of the coil (17);

v is the voltage (v) applied to the terminals of the coil (17);

RES is the resistance of the coil (17);

i is the current (i) circulating through the coil (17).

12. A method as claimed in claim 10, characterised in that the voltage ($v_a$) present at the terminals of an auxiliary coil (22) coupled to the magnetic circuit (18) and connecting with the magnetic flux (Φ) is measured, the auxiliary coil (22) being in substance electrically open, and the derivative over time of the magnetic flux (Φ) and the magnetic flux (Φ) itself being calculated by applying the following formulae:

$$\frac{d\varphi(t)}{dt} = \frac{1}{Na} \cdot v_{aus}(t)$$

$$\varphi(T) = \frac{1}{Na} \cdot \int_0^T v_{aus}(t)\,dt + \varphi(0)$$

in which:

Φ is the magnetic flux (Φ);

Na is the number of turns of the auxiliary coil (22);

$v_a$ is the voltage ($v_a$) present at the terminals of the auxiliary coil (22).

13. A method as claimed in claim 5, characterised in that a position (x) of the actuator body (4) with respect to the electromagnet (8) is determined as a function of the value assumed by the overall reluctance (R) of the magnetic circuit (18), the value of the overall reluctance (R) of the magnetic circuit (18) being calculated as a ratio between an overall value of ampere-turns associated with the magnetic circuit (18) and a value of the magnetic flux (Φ) passing through the magnetic circuit (18), the overall value of ampere-turns being calculated as a function of the value of a current (i) circulating through a coil (17) of the electromagnet (8).

14. A method as claimed in claim 13, characterised in that it is assumed that the overall reluctance (R) is formed by the sum of a first reluctance ($R_0$) due to an air gap (19) of the magnetic circuit (18) and a second reluctance ($R_{fe}$) due to the component of ferromagnetic material (16, 4) of the magnetic circuit (18), the first reluctance ($R_0$) depending on the constructional characteristics of the magnetic circuit (18) and on the value of the position (x) and the second reluctance ($R_{fe}$) depending on the constructional characteristics of the magnetic circuit (18) and on a value of a magnetic flux (Φ) passing through the magnetic circuit (18), the position (x) being determined as a function of the value assumed by the first reluctance ($R_0$).

15. A control method for an electromagnetic actuator (1) for the control of an engine valve (2), the method comprising the electrical supply of at least one electromagnet (8) for generating a force (f) of magnetic attraction acting on an actuator body (4), and being characterised in that an objective value ($\Phi_c$) of the magnetic flux (Φ) circulating in the magnetic circuit (18) formed by the electromagnet (8) and the actuator body (4) is determined and in that the electrical supply (i, v) of the electromagnet (8) is controlled as a function of the objective value ($\Phi_c$) of the magnetic flux (Φ), and wherein the objective value ($\Phi_c$) of the magnetic flux (Φ) is calculated as a function of an objective value ($f_{obj}$) of the force (f) of magnetic attraction acting on the actuator body (4) and generated by the electromagnet (8) and wherein the objective value ($f_{obj}$) of the force (f) of magnetic attraction is calculated as a function of an objective law of motion of the actuator body (4), and wherein the objective value ($f_{obj}$) of the force (f) of magnetic attraction is calculated by applying the following equation:

$$f_{obj}(t)=M^*a_{obj}(t)-B^*s_{obj}(t)-K_e^*(X_{obj}(t)-X_e)-P_e$$

in which:

$f_{obj}(t)$ is the objective value of the force (f) of magnetic attraction;

M is the mass of the actuator body (4);

B is the coefficient of hydraulic friction to which the actuator body (4) is subject;

$K_e$ is the elastic constant of a spring (9) acting on the actuator body (4);

$X_e$ is the position of the actuator body (4) corresponding to the rest position of the spring (9);

$P_e$ is the preloading force of the spring (9);

$x_{obj}(t)$ is the objective position of the actuator body (4);

$s_{obj}(t)$ is the objective speed of the actuator body (4);

$a_{obj}(t)$ is the objective acceleration of the actuator body (4).

16. A control method for an electromagnetic actuator (1) for the control of an engine valve (2), the method comprising the electrical supply of at least one electromagnet (8) for generating a force (f) of magnetic attraction acting on an actuator body (4), and being characterised in that an objective value ($\Phi_c$) of the magnetic flux (Φ) circulating in the magnetic circuit (18) formed by the electromagnet (8) and the actuator body (4) is determined and in that the electrical supply (i, v) of the electromagnet (8) is controlled as a function of the objective value ($\Phi_c$) of the magnetic flux (Φ), and wherein the objective value ($\Phi_c$) of the magnetic flux (Φ) is calculated as the sum of a firs contribution ($\Phi_{ol}$) calculated according to an open loop control logic and a second contribution ($\Phi_{cl}$) calculated according to a closed loop control logic, and wherein the second contribution ($\Phi_{cl}$) is calculated by feedback of an estimated real state of the actuator body (4) with respect to an objective state of the actuator body (4), and wherein the estimated real state of the actuator body (4) is defined from the estimated values of the position (x) of the actuator body (4), the speed (s) of the actuator body (4), and the magnetic flux (Φ), the objective state of the actuator body (4) being defined from the objective value ($x_{obj}$) of the position of the actuator body (4), the objective value ($s_{obj}$) of the speed of the actuator body (4) and the first contribution ($\Phi_{ol}$) of the objective value ($\Phi_c$) of the magnetic flux (Φ).

17. A control method for an electromagnetic actuator (1) for the control of an engine valve (2), the method comprising the electrical supply of at least one electromagnet (8) for generating a force (f) of magnetic attraction acting on an actuator body (4) and being characterised in that an objective value ($\Phi_c$) of the magnetic flux (Φ) circulating in the magnetic circuit (18) formd by the electromagnet (8) and the actuator body (4) is determined and in that the electrical supply (i, v) of the electromagnet (8) is controlled as a function of the objective value ($\Phi_c$) of the magnetic flux (Φ), and wherein the objective value ($\Phi_c$) of the magnetic flux ($\Phi$) is calculated as the sum of a first contribution ($\Phi_{ol}$) calculated according to an open loop control logic and a second contribution ($\Phi_{cl}$) calculated according to a closed loop control logic, and wherein the first contribution ($\Phi_{ol}$) is calculated as a function of an objective value ($f_{obj}$) of the force (f) of magnetic attraction acting on the actuator body (4) and generated by the electromagnet, and wherein the objective value ($\Phi_c$) of the magnetic flux ($\Phi$) is calculated by applying the following equation:

$$\varphi_{ol}(t) = \sqrt{\frac{-2 \cdot f_{obj}(t)}{\left(\frac{\partial R(x(t))}{\partial x}\right)_{\varphi}}}$$

in which $\Phi_{ol}(t)$ is the first contribution of the objective value ($\Phi_c$) of the magnetic flux ($\Phi$);

$f_{obj}(t)$ is the objective value of the force (f) of magnetic attraction;

x(t) is the position of the actuator body (4);

R(x, $\Phi$) is the reluctance of the magnetic circuit (18), and wherein a position (x) of the actuator body (4) with respect to the electromagnet (8) is determined as a function of the value assumed by the overall reluctance (R) of the magnetic circuit (18), the value of the overall reluctance (R) of the magnetic circuit (18) being calculated as a ratio between an overall value of ampere-turns associated with the magnetic circuit (18) and a value of the magnetic flux ($\Phi$) passing through the magnetic circuit (18), the overall value of ampere-turns being calculated as a function of the value of a current (i) circulating through a coil (17) of the electromagnet (8).

* * * * *

UNITED STATES PATENT AND TRADEMARK OFFICE

CERTIFICATE OF CORRECTION

PATENT NO. : 6,683,775 B2
DATED : January 27, 2004
INVENTOR(S) : Rossi et al.

It is certified that error appears in the above-identified patent and that said Letters Patent is hereby corrected as shown below:

Column 9,
Line 12, delete “circulatng” and insert -- circulating --

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,683,775 B2
DATED : January 27, 2004
INVENTOR(S) : Rossi et al.

It is certified that error appears in the above-identified patent and that said Letters Patent is hereby corrected as shown below:

Title page,
Item [75], Inventors, change "Bolonga" to -- Bologna --.

Signed and Sealed this

Thirtieth Day of May, 2006

JON W. DUDAS
*Director of the United States Patent and Trademark Office*